US007637576B2

(12) United States Patent
Sevillano Gil

(10) Patent No.: US 7,637,576 B2
(45) Date of Patent: Dec. 29, 2009

(54) BLOCKING SYSTEM FOR FURNITURE DRAWERS

(75) Inventor: Benito Sevillano Gil, Elgoibar (ES)

(73) Assignee: Ojmar, S.A., Elgoibar (ES)

( * ) Notice: Subject to any disclaimer, the term of this patent is extended or adjusted under 35 U.S.C. 154(b) by 401 days.

(21) Appl. No.: 10/541,958

(22) PCT Filed: Feb. 24, 2004

(86) PCT No.: PCT/ES2004/000084

§ 371 (c)(1),
(2), (4) Date: Jul. 8, 2005

(87) PCT Pub. No.: WO2004/104336

PCT Pub. Date: Dec. 2, 2004

(65) Prior Publication Data

US 2008/0203862 A1 Aug. 28, 2008

(30) Foreign Application Priority Data

May 23, 2003 (ES) ..... 200301218
Dec. 23, 2003 (ES) ..... 200303044

(51) Int. Cl.
*E05C 7/06* (2006.01)

(52) U.S. Cl. ..... 312/221; 312/218

(58) Field of Classification Search ..... 312/216–218, 312/220–221

See application file for complete search history.

(56) References Cited

U.S. PATENT DOCUMENTS

| | | | | | |
|---|---|---|---|---|---|
| 4,480,883 | A * | 11/1984 | Young | 312/220 |
| 4,838,624 | A * | 6/1989 | Walla | 312/221 |
| 4,889,396 | A * | 12/1989 | Mitchell et al. | 312/221 |
| 5,040,858 | A * | 8/1991 | Kruse et al. | 312/221 |
| 5,176,436 | A * | 1/1993 | Mitchell | 312/221 |
| 5,352,030 | A * | 10/1994 | Derle et al. | 312/221 |
| 6,082,839 | A * | 7/2000 | Chiku | 312/219 |
| 6,254,205 | B1 * | 7/2001 | Wright et al. | 312/217 |
| 6,779,855 | B2 * | 8/2004 | Hoffman | 312/219 |
| 6,796,625 | B2 * | 9/2004 | Lauchner et al. | 312/334.46 |
| 7,063,398 | B2 * | 6/2006 | Hoffman | 312/219 |
| 2003/0141790 | A1 * | 7/2003 | Weng | 312/217 |

* cited by examiner

*Primary Examiner*—Hanh V Tran
(74) *Attorney, Agent, or Firm*—Lucas & Mercanti, LLP

(57) ABSTRACT

A blocking system for file cabinets that including a pull shaft (c) linked to each drawer/guide (c), a support platen (1) fastened to the furniture, which defines a groove-rail (11) with at least two sections (11*a* and 11*b*) angled between each other, a mobile blocking element (2) outfitted with two emerging bolts (2*a* and 2*b*) that can move linearly, guided on the groove-rail (11) upon being pulled with the movement of the corresponding shaft (e), and mobile arms (3*a* and 3*b*) that are aligned between each other and which can move linearly within a maximum amplitude (a) on a vertical rail (12) defined on the support platen (1) where they are guided.

9 Claims, 4 Drawing Sheets

BLOCKING SYSTEM FOR FURNITURE DRAWERS

This invention concerns a blocking system for drawers that prevents a piece of furniture from overturning, particularly for office furniture and similar pieces of furniture.

Currently, file cabinets and similar furniture are used extensively for filing documents of all kinds (files, folders, etc.), and numerous devices have been developed to prevent various drawers from being opened at the same time, thereby preventing overturns. There are a huge number of patents in this regard. As examples, and among others, the following files could be cited, both of the applicant (EP1059402, U1030864, U1032265, U1039748) and of other patent holders (EP0286199, FR22365677, FR2173463, FR2677071, NL7604359, U.S. Pat. No. 4,768,844).

In most of the existing systems that make up the current state of the art, the components of the devices are manufactured according to the size of the furniture or drawers, such that for each manufacturer and for each piece of furniture, elements of different sizes must be manufactured, which prevents standardisation and increases the prices.

The following are problems inherent to current systems, including systems that attempt to achieve standardisation:

a) an excessive number of components, or the use of complex components that are difficult to manufacture, difficult to install and/or difficult to operate;

b) excessive limitations imposed by the mechanism manufacturer upon the furniture manufacturer;

c) operating and blocking devices arranged in opposite directions or in inappropriate places;

d) lack of safety in the event of improper handling;

e) impossibility of opening in the event of accidental closing.

Other problems and limitations of the known systems for blocking file cabinets are of a purely technical or construction nature: One or more parts must rotate, which complicates the mechanism excessively.

The system, object of the invention, overcomes these problems: It supports a new blocking system for file cabinets in which all the component parts move and are guided linearly.

The system, in accordance with the invention, consists of a pull shaft connected to each drawer/guide, which operates a corresponding blocking device, with all the blocking devices of all the drawers interconnected to each other such that opening one drawer prevents all the other drawers from being opened, and it is characterised by the fact that for each drawer/guide, it contains the following:

a) a support platen fastened to the furniture, which defines a groove-rail with at least two angular sections between each other;

b) a mobile blocking element provided with two emerging bolts that can move linearly, guided on the said groove-rail when pulled by the corresponding shaft, fastened to the drawer or to the guide when it moves linearly;

c) mobile arms aligned between each other, one positioned above and the other below, which can move a maximum amplitude (a) linearly on a vertical rail defined on the support platen where they are guided.

The width of the groove-rail, the diameter of the pull shaft, the diameter of the bolts and the maximum amplitude that the mobile arms can move linearly is the same, such that, with any drawer open, the opening of all other drawers is blocked.

The said upper mobile arms have an upper ramp, which is initially impacted by one of the bolts of the blocking element, so that when one of the drawers is opened, it guides their movement, thereby blocking the opening of the remaining drawers.

Additionally, the system includes the following:

recovery means that tend to move one way in vertical approximation to the said mobile arms as the bolts move horizontally, thereby leaving available the amplitude (a) existing between two mobile arms;

at least one bar-rod associated at both ends with two mobile arms of two, contiguous support platens.

In particular, the said recovery means consist of springs that abut against the corresponding mobile arm and the support platen on which it is installed, and the blocking element has an extra-flat configuration, with its bolts emerging towards the same face.

In order to understand the object of this invention better, the drawings present the preferred way of practical execution, which may be subject to accessory changes that do not detract from its basic structure.

Figure 1:
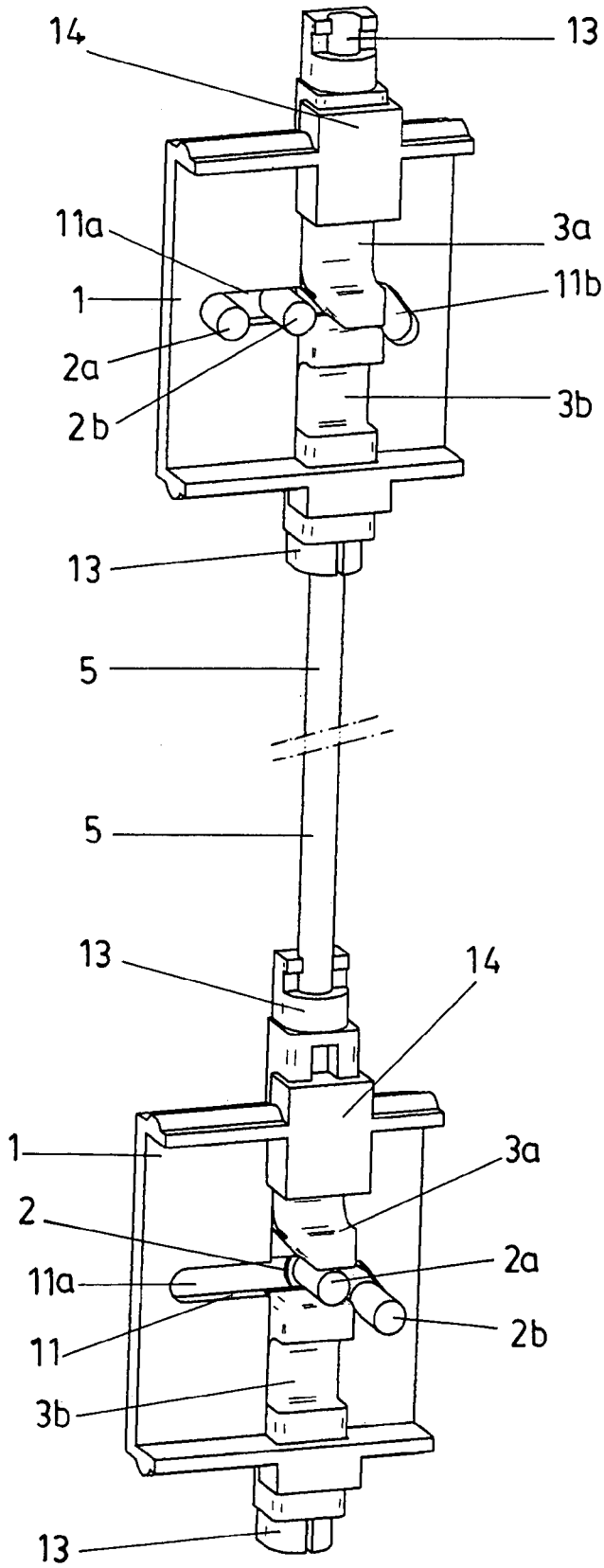
FIG. 1 is a general perspective view, and it schematically represents a blocking system for file cabinets, object of the invention, with its basic components arranged in the operating position, with the lower module in the "drawer open" position and the upper module in the "drawer closed" position.
Figure 2:
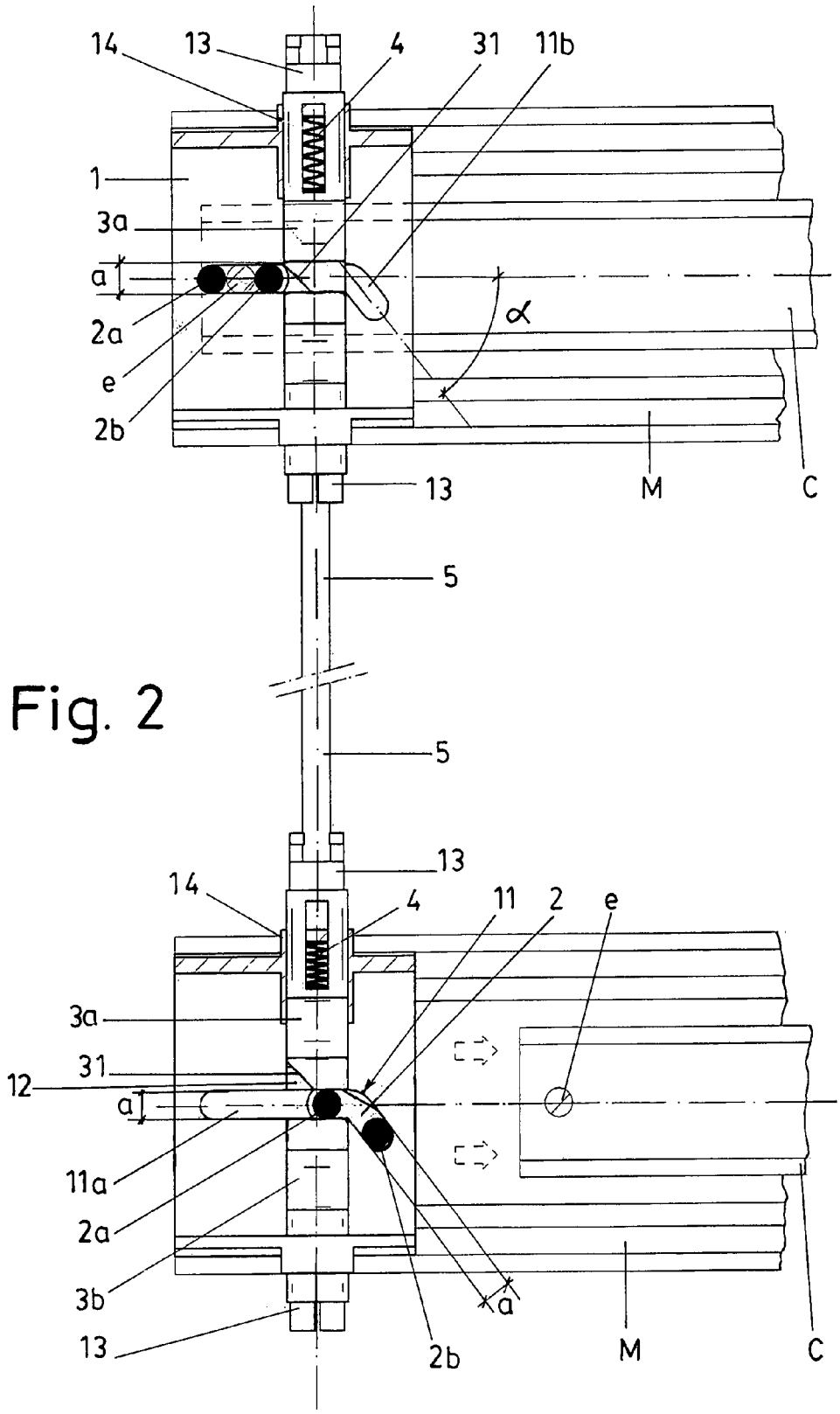
FIG. 2 is a general elevation view, and it schematically represents a blocking system for file cabinets with its basic and associated components on two drawers (c), with the lower module in the "drawer open" position and the upper module in the "drawer closed" position.
Figure 3A:
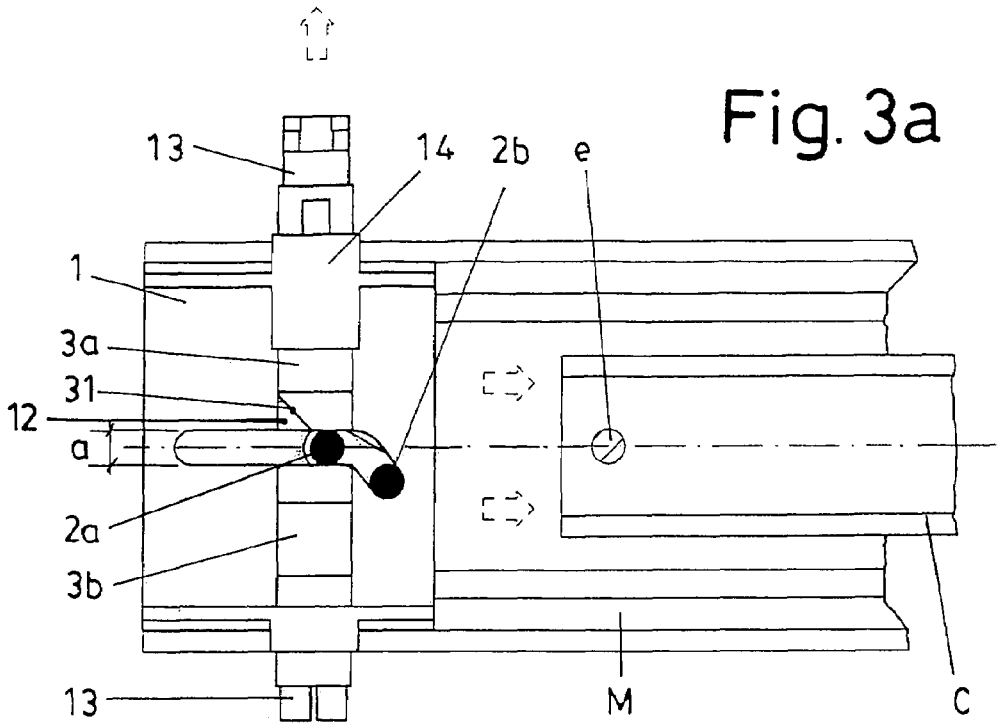
FIG. 3 represents the front elevation detail of a module in movement to the "drawer open" position—FIG. 3*a* —and in movement to the "drawer closed" position—FIG. 3*b* —for an unrestricted example of practical execution.
Figure 3B:
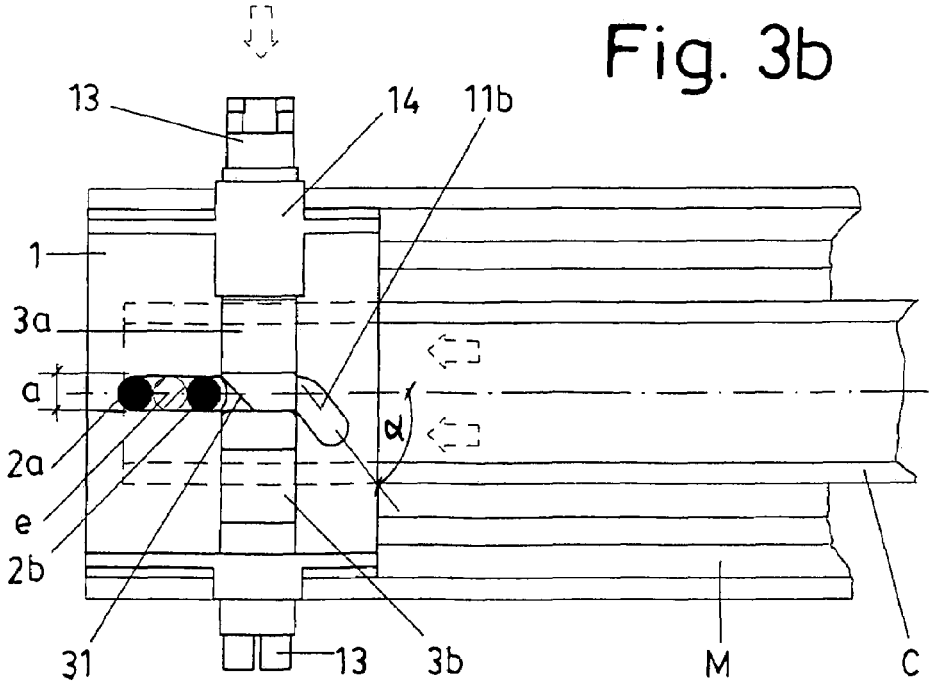
Figure 4A:
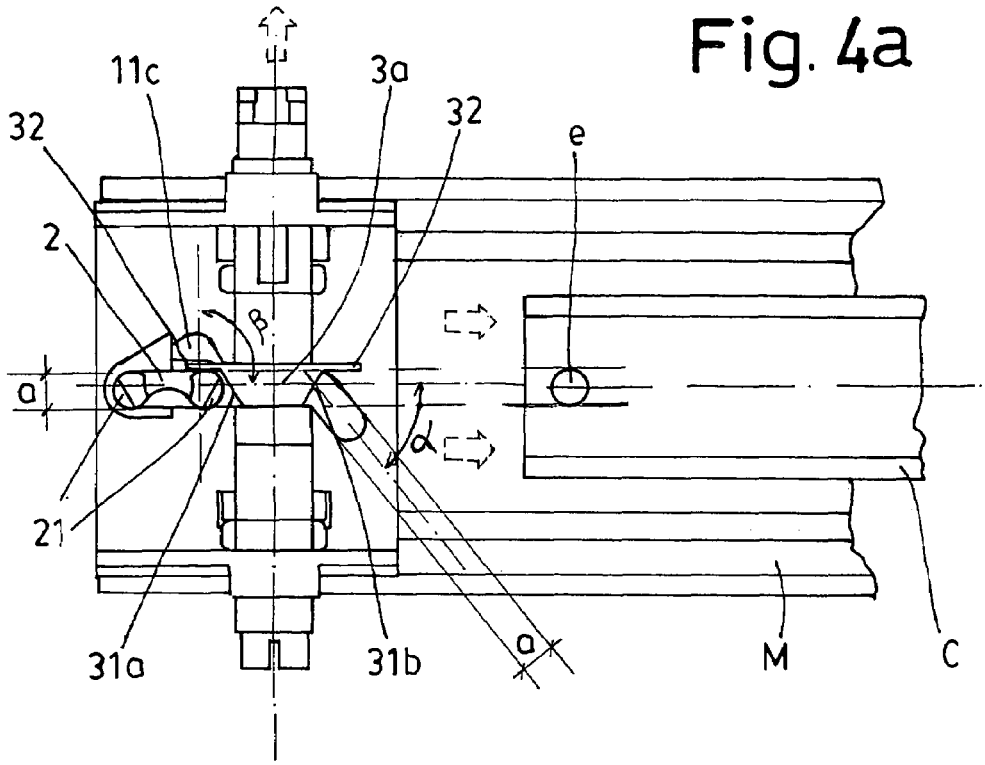
Figure 4B:
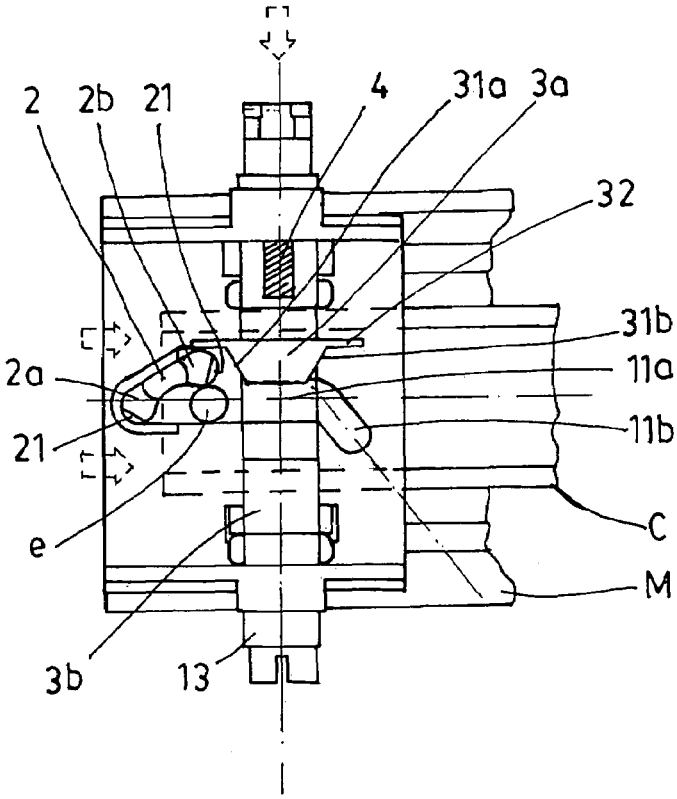

FIGS. 4*a* and 4*b* are similar views to 3*a* and 3*b*, but thereby representing a variation to solve an aberrant situation.

An aberrant situation occurs when, by accident, the bolts (2*a* and 2*b*) of the blocking element (2) remain on the first section (11*a*) of the groove-rail (11) and the pull shaft (e) remains outside of them (FIG. 4*a*).

A non-restrictive example of a practical execution of the invention is described below.

The blocking system for file cabinets, in accordance with the invention, is applicable to furniture (M) with drawers, and it consists of a pull shaft (e) connected to the drawer or its guide (c), which pull shaft (e) operates a corresponding blocking device.

In accordance with the invention, the blocking system for file cabinets used basically in office furniture and similar furniture consists of the following, in correlation to all the drawers (c) of a piece of furniture (M):

a support platen (1)

a blocking element (2)

mobile arms, one (3*a*) positioned above and the other (3*b*) positioned below the support platen (1).

It all forms a modular assembly (for each drawer).

The following are also included:

recovery means—springs (4).

at least one bar-rod (5), which, associated at its ends to two mobile arms (3*a* and 3*b*) of two contiguous support platens (1), constitutes the connection point between every two consecutive modular assemblies, meaning between every two contiguous drawers (c).

According to the represented execution, each support platen (1):

a) defines a groove-rail (11) with at least a first section (11*a*) and a second section (11*b*) angled between each other—the angular amplitude ($\alpha$);

b) makes up a rail-guide (12) orthogonal to one of the sections (11*a*) of the said groove-rail (11), which is continued through both ends on similar housings (13), which are coaxial to each other and to the said rail-guide (12);

c) it contains a sleeve (14) that houses at least one spring (4).

According to the represented execution, each blocking element (2) is structured in a single-piece body from which two bolts (2*a* and 2*b*) emerge towards the same side.

According to the represented execution, one of the mobile arms—by position, the upper mobile arm (3*a*)—comprises an end ramp (31).

The system, object of the invention, fulfils the following dimensional relationship:

The maximum amplitude that the mobile arms (3*a* and 3*b*) and the rods (5) associated therewith can move linearly, the diameter of the bolts (2*a* and 2*b*) of the blocking element (2), and the diameter of the pull shaft (e) associated with the drawer or its guide (c) is the same or appreciably the same—it is indicated as dimension "a" in the drawings.

All other, alternative practical executions that do not alter, change or modify the proposed essence are hereby included in the object of the invention: For example, the groove-rail (11) makes up more than two end sections angled with respect to the former with angular amplitudes ($\alpha$ and $\beta$) that are equal to or different from each other and oriented towards the same side or towards different sides.

With these components and structuring, and in order to achieve the blocking system, object of the invention, the installation is as follows:

a) with the support platen (1) fastened to the piece of furniture (M) such that one of the ends (11*a*) of its groove-rail (11) is arranged horizontally and the other section (11*b*) forms an angle ($\alpha$) with respect to horizontal.

The arms (3*a* and 3*b*) and rods (5) associated therewith are guided vertically;

b) on each module, one of the arms (3*a*) tends to descend due to the action of the spring (4), thereby forcing the remaining arms (3*a* and 3*b*). The action of the springs (4) accumulates in the mechanism as a whole;

c) the blocking element (2) is mounted by housing its bolts (2*a* and 2*b*) in the groove-rail (11).

The operation takes place as follows:

a) with all the drawers (c) closed, the bolts (2*a* and 2*b*) of the blocking element (2) are housed in the horizontal section (11*a*) of the groove-rail (11), and the pull shaft (e) is arranged between them both. In this position, the springs (4) act by making the entire rod (5) and mobile arm (3*a* and 3*b*) assembly descend such that the amplitude (a) is in the highest area of the mechanism.

b) when any of the drawers (c) is opened, the shaft (e) pulls the blocking element (2), thereby pushing its bolt (2*b*), which, as it moves, runs into the ramp (31) of the mobile arm (3*a*), which elevates and lifts all the other, upper mobile arms (3*a*) with it, thereby preventing the lower mobile arms (3*b*) from moving. The amplitude (a) has transferred to this zone, and it houses the bolt (2*a*) of the blocking element (2) once the pull shaft (e) continues its path when the drawer (c) is opened, now released from the bolt (2*a*)—which has been housed in section (11*b*) of the groove-rail (11).

To the extent that a drawer (c) remains open—meaning with bolt (2*a*) pressed between two arms (3*a* and 3*b*) by the action of the springs (4)—all other drawers (c) will remain closed and blocked, since the remaining arms (3*a* and 3*b*) cannot move, and even the corresponding bolt (2*b*) runs into the corresponding ramp (31).

According to the variation in FIG. 4, the groove-rail (11) also has a third section (11*c*), in continuity with its section 11*a*. Sections 11*a* and 11*c* are angled between each other, thereby forming angle $\beta$.

Each blocking element (2) is structured in a single-piece body from which two bolts (2*a* and 2*b*) emerge towards the same side, and at least one of them presents a bevel (21).

It can also be appreciated how the mobile arms (3*a*) present two, opposing end ramps (31*a* and 31*b*) (meaning that they are arranged symmetrically with respect to the axis of movement) and at least one push rod (32) arranged in front, over a third section (11*c*) of the groove-rail (11).

The variation in FIGS. 4*a* and 4*b* includes the following:

a) the bolts (2*a* and 2*b*) have a ramp/bevel (21), which makes it possible for a same blocking element (2) to indistinctly go to the right or left;

b) the mobile arms (31) have two push rods (32) arranged symmetrically, which makes it possible for the same mobile arm (3*a*) to go indistinctly to the right or left.

An irregular situation is presented in FIGS. 4*a* and 4*b*, in which, with any drawer (c) open, bolts 2*a* and 2*b* of the blocking element (2) are housed in the horizontal section (11*a*) of the groove-rail (11), and the pull shaft (e) is adjusted away from them both. In this position, the springs (4) act by making the entire rod (5) and mobile arm (3*a* and 3*b*) assembly descend such that the amplitude (a) is in the highest area of the mechanism, whereby any other drawer (c) can be opened.

With the presented solution, the drawer (c) corresponding to the blocking element located in the irregular position simply has to be closed so that:

a) the pull shaft (e) pushes first on the end ramp (31*b*) of the mobile arm (3*a*) in order to elevate it on the guide (12) and then push on the bolt (2*b*) in order to lift it in the third section (11*c*) of the groove-rail (11). This latter action is facilitated by the ramp/bevel (21) of the bolt (2*b*).

b) once the shaft (e) has passed the bolt (2*b*), the push rod (32) of the mobile arm (3*a*) presses on it due to the action of the spring (4) and forces it to return to the correct operating position and with the drawer (c) closed.

The invention claimed is:

1. A blocking system for a file cabinet having multiple drawers comprising:

a) a pull shaft provided on a drawer guide for each drawer of the multiple drawers b) a support platen for fastening to the file cabinet for each drawer of the multiple drawers each support platen having a groove-rail with at least a first section and a second section forming an angle with each other;

c) a mobile blocking element engaged with the groove-rail for each support platen, each blocking element provided with two emerging bolts that move linearly within the groove-rail, wherein the two emerging bolts are arranged with a distance in between to accommodate the pull shaft;

d) two mobile arms aligned vertically with each other with two meeting ends, one of the two meeting ends having an end ramp, said mobile arms are movably installed on a vertical rail on each of the support platen, which can move linearly on the vertical rail with a maximum amplitude;

wherein the mobile blocking element is pulled by the pull shaft under the end ramp and placed between the meeting ends of the two mobile arms for opening one drawer and for preventing all other drawers from being opened.

2. A The blocking system of claim 1, wherein the width of each groove-rail, the diameter of each pull shaft, the diameter of the bolts and the maximum amplitude that the mobile arms can move linearly, each has a same dimension.

3. The blocking system of claim 1, wherein on each support platen there are recovery means that tend to move in one direction in vertical approximation to the said mobile arms when the bolts move horizontally, thereby leaving available the amplitude existing between two mobile arms.

4. The blocking system of claim 1, wherein each blocking element has an extra-flat configuration and its bolts emerge towards the same face.

5. The blocking system of claim 3, wherein each recovery means consist of springs that abut against the corresponding mobile arm and the support platen on which it is mounted.

6. The blocking system of claim 1, wherein a bar-rod extends between two mobile arms of two contiguous support platens.

7. The blocking system of claim 1, wherein each groove-rail has a third section, connected to it horizontal section, which is angled with respect to the later and capable of housing one of the bolts of the blocking element.

8. The blocking system of claim 7, wherein one of the bolts of each blocking element faces the pull shaft when the drawers are closed and has a ramp, and the upper mobile arm has two, opposing lateral ramps that impact against the one of the bolts.

9. The blocking system of claim 7, wherein one of the bolts of each blocking element faces the pull shaft when the drawers are closed and has a ramp, and the upper mobile arm has two, opposing lateral ramps that impact against the one of the bolts and the upper mobile arm has at least one push rod in front of the third section of the groove-rail.

* * * * *